United States Patent [19]

Gemmen et al.

[11] Patent Number: 4,993,680

[45] Date of Patent: Feb. 19, 1991

[54] EASY VIEWING AND SPACE SAVING DOCUMENT HOLDER

[76] Inventors: Randall S. Gemmen; Marian G. Armour-Gemmen, both of 51 Murdell Ln., Apt. 2, Livermore, Calif. 94550

[21] Appl. No.: 462,710

[22] Filed: Jan. 9, 1990

[51] Int. Cl.[5] ..... F16M 13/00

[52] U.S. Cl. ..... 248/444.1; 248/447.1

[58] Field of Search ..... 248/444.1, 447, 447.1

[56] References Cited

U.S. PATENT DOCUMENTS

| | | | |
|---|---|---|---|
| 4,116,414 | 9/1978 | Robertson | 248/451 |
| 4,184,725 | 1/1980 | Spangler | 248/447 X |
| 4,239,170 | 12/1980 | Panebo | 248/441 B |
| 4,369,948 | 1/1983 | Krauss et al. | 248/447 X |
| 4,403,761 | 9/1983 | Jamar | 248/447.1 |
| 4,452,416 | 6/1984 | Templeton | 248/447.2 |
| 4,460,145 | 7/1984 | Ando | 248/447 |
| 4,684,099 | 8/1987 | Krapf | 248/447.1 |
| 4,718,630 | 1/1988 | Richard | 248/444.1 |
| 4,867,407 | 9/1989 | Becker | 248/444.1 |

*Primary Examiner*—David M. Purol

[57] ABSTRACT

A compact document holder (20) which is maintained in a vertical position via tie-bars (24) and mounting brackets (26). The base of the holder is provided with an elongated ledge (36) extending outward to engage the document so as to maintain it secure within the holder. The tie-bars (24) facilitate the opening of the holder for the insertion of the documents as well as maintaining the document secure within the holder via the downward force provided by the weight of the document.

10 Claims, 2 Drawing Sheets

EASY VIEWING AND SPACE SAVING DOCUMENT HOLDER

BACKGROUND

1. General Field of Invention

This invention relates to supports and holders for documents such as books, magazines, pamphlets, or other graphic type material.

2. Prior Art

The need for document holders or supports has been known for a long time, and the prior art describes many different methods for satisfying these needs. U.S. Pat. No. 4,116,414 issued Sept. 26, 1978 to Vivian Robertson presents a rigid sheet having a ledge secured thereto along a marginal edge and outstanding therefrom. Another sheet is hingeably secured to the rigid sheet at an opposed marginal edge. A flexible slat is secured to an opposite edge of the hingeable sheet and is also secured to the ledge carrying sheet on a surface opposite to the location of the ledge. A pair of clothespin like pinching devices are attached to a pair of flexible cord-like members on the surface of the ledge carrying sheet to maintain pages of a book open. Thus when in use, the Robertson apparatus may be folded up and placed in the hand, or left opened in a stable condition upon a flat surface. The Robertson device therefore requires it either to be constantly held in the hand, or to be placed upon a flat surface such as a table. Either method can at times be terribly inconvenient for the user. While using the Robertson device in the hand enables the user to have easy and immediate eye-level sight of the document, it nonetheless makes the user far less productive. And although using the Robertson device on a table allows the use of both hands, it necessarily takes up needed working space which is often unacceptable.

U.S. Pat. No. 4,452,416 issued June 5, 1984 to Michael S. Templeton presents a display device with a base for retaining a pair of material or article support rods having one end of each rod secured to the base. The pair of rods extend upwardly in a diverging relation and slidably support a spring biased clip on each rod for retaining materials for display. Thus when in use, the Templeton device requires a flat surface and once again takes up needed working space.

U.S. Pat. No. 4,239,170 issued Dec. 16, 1980 to Sten Planebo presents a support device for a writing board or the like. The device is maintained secured to a vertical surface such as a wall by a pair of arms opening downwardly for riding on rails. No mechanisms are provided in the Panebo apparatus for securing the displayed articles. Thus when in use, the Panebo device requires that the user supply mechanisms for maintaining the articles in a secure fashion upon the vertical board, thereby making the device inconvenient to use.

Review of the prior art shows that heretofore all devices suffer from a number of disadvantages:

(a) Their use often requires space be made available on a table or other flat surface. Such space taken up by the holder is often in conflict with other activities occurring on the table.

(b) Complicated or inconvenient mechanisms are required for the use of the device. Setting up the holder is often times a tedious and needlessly complicated process of fixing and securing various articles and members together.

(c) Special attention is often required toward fixing the document upon the surface of the holder in complicated or inconvenient ways—tapes, pins, clamps, straps, wires, etc.

(d) Many holders supply no mechanisms whatsoever for securing the pages of a document in an open fashion.

(e) Many holders offer no mechanisms for collapsing the device in a compact condition for storing while at the same time providing, when required, immediate access for use due to some amount of required assembly.

SUMMARY OF THE INVENTION

Accordingly, several objects of the present invention are:

(a) to provide a support for any type of document, i.e., book, magazine, pamphlet, newspaper, or drawing, so as to maintain the pages in an open position for examination.

(b) to provide a holder which is realistically compact when in use or when not in use.

(c) to provide a holder that requires no assembly when immediate use is required.

(d) to provide a holder that supplies its own mechanisms for maintaining the pages of a document in an open fashion without the need for complicated devices such as tapes, pins, clamps, straps, wires, or other such mechanisms.

(e) to provide a holder that can be readily manufactured from existing technologies.

(f) to provide a holder that enables the user to write upon the surface of the holder at desired locations over the document for adding notes or other points of information without directly affecting the original document.

(g) to provide a holder that is not strongly affected by weather and may be used indoors or outdoors.

(h) to provide a holder that reasonably protects the document from damage due to such things as liquids, pastes, dusts or other possible abuses.

Further objectives are to provide a holder that can be easily viewed depending upon the intended use. For example, often times book holders are required for people who cook from written recipes. As noted previously, past holder designs were often those that required table space. Since cooking is often performed standing up, it is often inconvenient for cooks to bend down to the table level from a standing position in order to read the recipe. In addition, cooks use table space extensively; therefore, they cannot afford to place such devices near to the work area making these devices even more inconvenient. The present invention avoids all these problems, since the present invention can be attached to a cupboard door. Hence, the present invention provides a holder at eye-level for easy viewing and at the same time provides more table space by removing the holder from the table. Moreover, as per point (h) above, the recipe often times becomes deteriorated when in such an environment, since the cooks' working space is rarely neat and clean nor are their hands. By placing the document behind the transparent sheet, the document can remain clean.

Further objects and advantages will become apparent when examining the drawings and the ensuing description.

REFERENCE NUMERALS USED IN DRAWINGS

Figure 1:
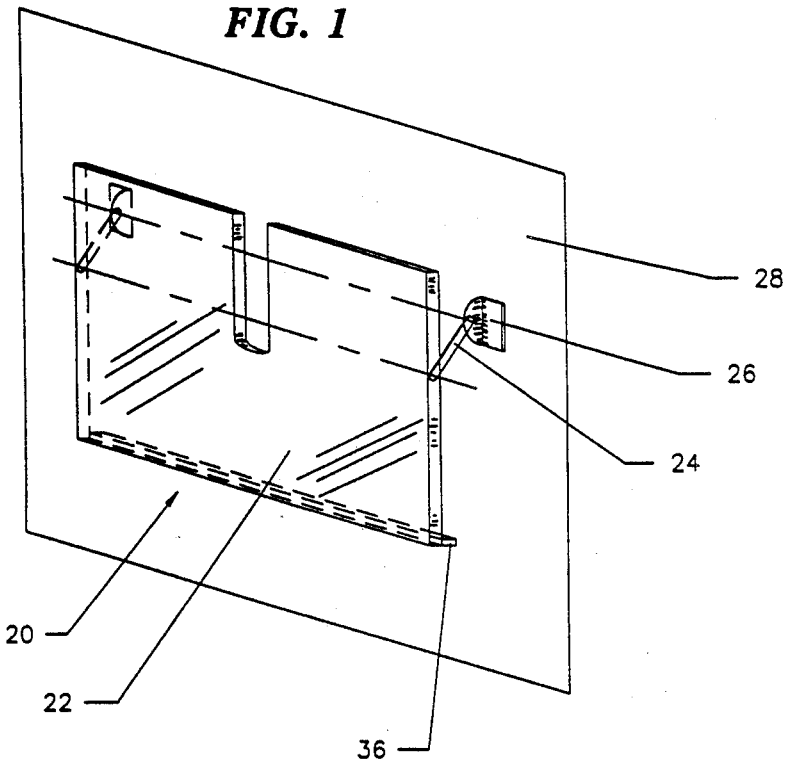
FIG. 1 is a perspective view of the present invention.

20 present invention
22 transparent rigid sheet
24 tie-bar
26 mounting bracket
28 mounting surface
30 document
32 hand
34 hand
36 ledge

DESCRIPTION OF THE INVENTION

Figure 2:
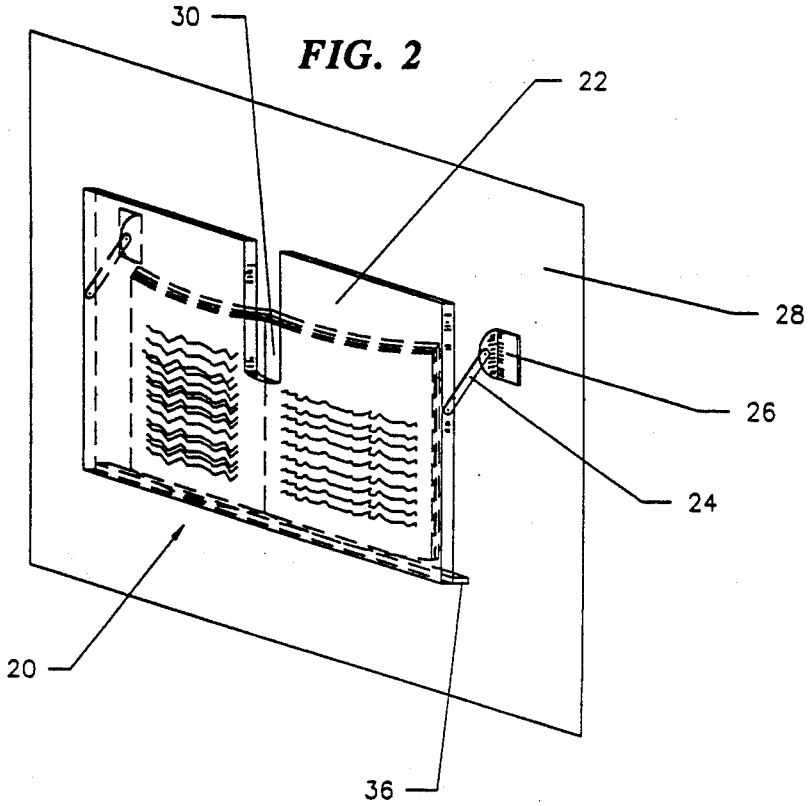
FIG. 2 is a perspective view of the present invention shown with a document therein.

A typical embodiment of the holder in the present invention is illustrated in FIG. 1 and FIG. 2. The holder is provided a clear transparent rigid sheet hung from a vertical or near vertical mounting surface. The backside surface of this sheet is provided an extending ledge affixed thereto and positioned at the lowermost elongated edge thereof. The ledge provides a document supporting surface of appropriate width and length to maintain the document in a secure position between the transparent rigid sheet and the mounting surface when the transparent rigid sheet is hung therefrom. A pair of tie-bars are utilized for the purpose of hanging the transparent rigid sheet to the mounting surface. The tie-bars can be attached to the transparent rigid sheet with a variety of joints so as to supply a rotating action about a horizontal direction parallel to the transparent rigid sheet. In like manner, mounting brackets are provided for the attachment of the tie-bars to the mounting surface. The tie-bars can be attached to the mounting brackets with a variety of joints so as to supply a rotating action about a horizontal direction parallel to the first horizontal and at a distance away from the mounting surface that is smaller than that of the joint at the transparent rigid sheet. The mounting brackets can be attached to the mounting surface in a variety of ways such as tapes, rivets, glues or screws. The transparent rigid sheet may be provided with a vertical slot in the center of the sheet and of sufficient width to allow the insertion of the fingers of a hand and of sufficient height to permit access to documents inserted therein. The transparent rigid sheet can be fabricated from a variety of transparent materials, but are preferably fabricated from lightweight materials, such as plastic, particularly polystyrene. In addition, the transparent rigid sheet material may permit the application of marks, notes, drawings, or other such added information to its surface from such articles as pens or pencils for example, wax pens or pencils for polystyrene rigid sheets. The tie-bars and mounting brackets can also be manufactured from a variety of materials including metals, metal alloys, plastics or any rigid material of sufficient strength and durability so as to maintain the assembly in a secured position. The width and height of the transparent rigid sheet and the length of the tie-bars can be of variety of sizes so as to supply a range of holders for any application.

Now refer to FIG. 1 and FIG. 2 showing present invention 20 having a rigid transparent sheet 22, with FIG. 2 shown having a document 30 placed between the sheet and mounting surface 28. Attached to the transparent rigid sheet are tie-bars 24 along the left and right edges. Also attached to the transparent rigid sheet is an elongated ledge 36 to engage the base of a document so as to maintain the document secure between the transparent rigid sheet and the mounting surface. The joints for the tie-bars and the transparent rigid sheet provide a rotating motion along a horizontal direction depicted by a dashed line in FIG. 1. Mounting brackets 26 provide attachment of the holder to mounting surface 28. The mounting brackets provide a second horizontal rotating joint for the tie-bars which is parallel to the first horizontal direction, this horizontal direction also being depicted by a dashed line in FIG. 1. Together, the two horizontal rotating axes permit the free movement of the transparent rigid sheet toward and away from the mounting surface.

Figure 3:
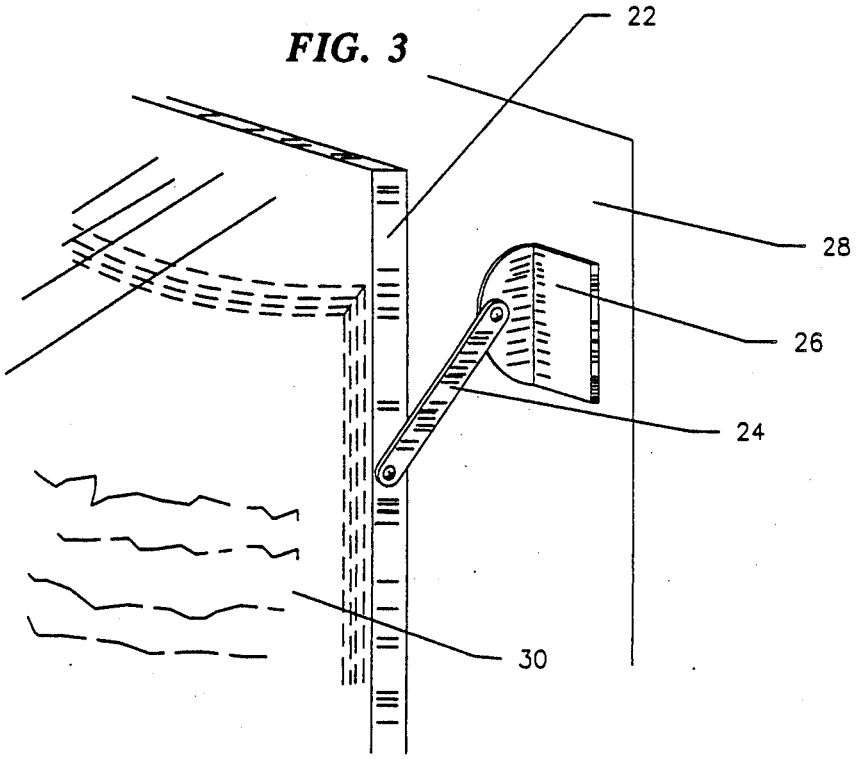
FIG. 3 is an enlarged view of a portion of the present invention.

FIG. 3 illustrates the interconnections between tie-bars 24 and transparent rigid sheet 22 and between the tie-bars and mounting brackets 26 for one typical embodiment.

Figure 4:
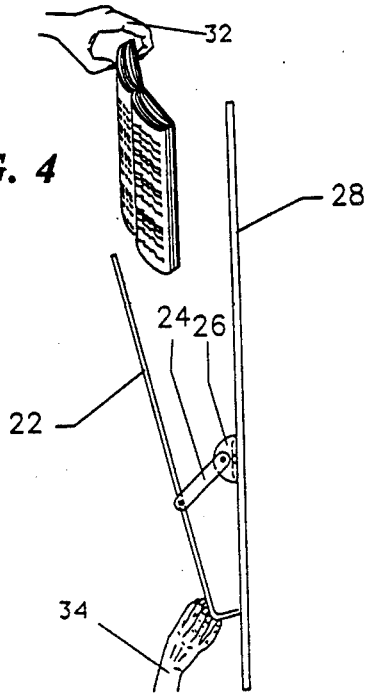
FIG. 4 is an edge view at time of insertion or removal of a document from the present invention.

FIG. 4 shows an edge view of the holder at time of insertion or removal of a document from the holder. During insertion, hand 32 holds document 30, while hand 34 facilitates the opening of the holder by lifting the base of the holder in a vertical direction allowing tie-bars 24 to rotate thereby opening the top of the holder for the insertion of the document. Once the document is in place, hand 34 lowers the holder allowing the weight of the document alone to force the rigid surface tight against the document via the tie-bars thereby maintaining the document secure therein and in an open condition.

CONCLUSIONS, RAMIFICATIONS AND SCOPE OF THE INVENTION

From the description above, a number of advantages of our document holder become evident:

(a) The invention provides a support for any type and size of document, i.e., book, magazine, pamphlet, newspaper, or drawing, so as to maintain the pages in an open position for examination.

(b) The invention provides a holder which is realistically compact when in use or when not in use. A specific example would be the placement of the holder on the inside of a kitchen cupboard door. When the holder is required for cooking, for example, the user needs simply open the cupboard door and place the recipe, which is in a book, folder, or possibly cooking magazine into the holder. When finished, the user needs simply close the cupboard door and the holder will immediately be in its stored position, laying compactly flat against the cupboard door.

(c) The invention provides a holder that requires no assembly when immediate use is required.

(d) The invention provides a holder that supplies its own mechanisms for maintaining the pages of a document in an open fashion without the need for complicated devices such as tapes, pins, clamps, straps, wires, or other such mechanisms. The weight of the document alone maintains the document securely pinched between the transparent rigid sheet and the mounting surface.

(e) The invention provides a holder that can be readily manufactured from existing technologies. Lightweight plastic materials are preferred, although other materials are possible.

(f) The invention provides a holder that enables the user to write upon the surface of the holder at desired locations over the document for adding notes or other points of information without directly affecting the original document. By using a transparent rigid surface with the document contained behind, the user can easily write upon the surface with pens whose ink can be cleaned from the surface when they no longer needed.

(g) The invention provides a holder that is not strongly affected by the weather and may be used indoors or outdoors.

(h) The invention provides a holder that reasonably protects the document from damage due to such things as liquids, pastes, dusts or other possible abuses.

(i) The invention provides a holder that can be easily examined according to the intended use.

Thus, there is disclosed in the above description and drawings, and embodiment of the invention which fully accomplishes the objects thereof. It is easily apparent to the skilled reader, however, how to make modifications to the present invention. Therefore, the scope of the invention should be determined by the appended claims and their legal equivalents, and not by the examples given.

We claim:

1. A book or document holder for mounting on a vertical flat surface comprising a single transparent rigid sheet, a single elongated ledge, two tie-bars, and two mounting brackets, said transparent rigid sheet having said elongated ledge attached parallel to the lower edge thereof and extending inward toward said vertical flat surface from said transparent rigid sheet, so as to be disposed therebetween, said tie-bars being attached along opposed edges of said transparent rigid sheet with means for rotating said tie-bars about a horizontal axis, said mounting brackets joined to another end thereof of said tie-bars with means for rotating said tie-bars about a horizontal axis parallel to first said horizontal axis, and with means for attaching said mounting brackets to said vertical flat surface, wherein said inwardly extended elongated ledge permits said book or document to be forcibly maintained between said transparent rigid sheet and said vertical flat surface solely due to the weight of said book on said elongated ledge thereby forcing said transparent rigid sheet downward and toward said vertical flat surface whenever said book or document is appropriately placed between said vertical flat surface and said transparent rigid sheet.

2. The apparatus of claim 1 comprising a vertical slot in said transparent rigid sheet beginning at the top edge of said transparent rigid sheet and ending approximately in the middle of said transparent rigid sheet, with said slot of sufficient width to permit the insertion of the fingers of a person's hand whereby a person can have ready access to documents or books contained therein.

3. The apparatus of claim 1 wherein said transparent rigid sheet is composed of polystyrene.

4. The apparatus of claim 1 wherein said transparent rigid sheet is composed of a plastic material with means for applying hand written or printed information to its surface.

5. The apparatus of claim 1 wherein said tie-bars and mounting brackets are composed of rigid plastic.

6. The apparatus of claim 1 wherein said tie-bars and mounting brackets are composed of rigid metal alloys.

7. The apparatus of claim 1 wherein said elongated ledge is formed as an integral part of said transparent rigid sheet.

8. The apparatus of claim 1 wherein said transparent rigid sheet is a rectangle.

9. The apparatus of claim 1 wherein said transparent rigid sheet is composed of a colored transparent plastic material.

10. The apparatus of claim 1 wherein said elongated ledge is attached to said transparent rigid sheet using screws.

* * * * *